US009302281B2

(12) United States Patent
Micheli et al.

(10) Patent No.: US 9,302,281 B2
(45) Date of Patent: Apr. 5, 2016

(54) HIGH SWIRL AIR CAP

(75) Inventors: Paul Micheli, Glen Ellyn, IL (US); Mitch Drozd, Harwood Hts, IL (US); Nekheel Gajjar, Chicago, IL (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 606 days.

(21) Appl. No.: 13/356,513

(22) Filed: Jan. 23, 2012

(65) Prior Publication Data

US 2012/0187220 A1 Jul. 26, 2012

Related U.S. Application Data

(60) Provisional application No. 61/435,737, filed on Jan. 24, 2011.

(51) Int. Cl.

| | |
|---|---|
| ***B05B 1/34*** | (2006.01) |
| ***B05B 7/06*** | (2006.01) |
| ***B05B 7/08*** | (2006.01) |
| ***B05B 7/24*** | (2006.01) |

(52) U.S. Cl.

CPC ..... *B05B 7/067* (2013.01); *B05B 7/083* (2013.01); *B05B 7/0815* (2013.01); *B05B 7/0838* (2013.01); *B05B 7/2405* (2013.01)

(58) Field of Classification Search

CPC ..... B05B 7/067; B05B 7/06; B05B 7/0823; B05B 7/0815; B05B 7/0838

USPC ..... 239/290, 291, 296, 298, 299, 300

See application file for complete search history.

(56) References Cited

U.S. PATENT DOCUMENTS

| | | | | |
|---|---|---|---|---|
| 478,295 | A * | 7/1892 | Squire | 239/406 |
| 2,139,133 | A * | 12/1938 | Paasche | 239/298 |
| 6,311,899 | B1 * | 11/2001 | Hidaka et al. | 239/298 |
| 6,793,155 | B2 * | 9/2004 | Huang | 239/296 |
| 6,808,122 | B2 | 10/2004 | Micheli | |
| 7,028,916 | B2 | 4/2006 | Micheli | |
| 7,311,271 | B2 | 12/2007 | Micheli | |
| 7,568,635 | B2 | 8/2009 | Micheli | |
| 7,762,476 | B2 | 7/2010 | Micheli | |
| 7,789,327 | B2 | 9/2010 | Micheli et al. | |
| 7,926,733 | B2 | 4/2011 | Micheli | |
| 7,992,808 | B2 | 8/2011 | Micheli | |
| 2004/0031860 | A1 | 2/2004 | Micheli | |
| 2006/0214027 | A1 * | 9/2006 | Micheli | 239/418 |
| 2007/0221762 | A1 | 9/2007 | Micheli et al. | |
| 2008/0017734 | A1 | 1/2008 | Micheli et al. | |
| 2008/0048055 | A1 | 2/2008 | Micheli | |
| 2008/0296409 | A1 | 12/2008 | Micheli | |
| 2009/0148612 | A1 | 6/2009 | Micheli | |
| 2009/0230218 | A1 | 9/2009 | Drozd | |
| 2009/0277976 | A1 | 11/2009 | Micheli et al. | |
| 2009/0302133 | A1 | 12/2009 | Micheli et al. | |
| 2010/0108784 | A1 | 5/2010 | Drozd et al. | |

* cited by examiner

*Primary Examiner* — Jason Boeckmann

(74) *Attorney, Agent, or Firm* — Fletcher Yoder P.C.

(57) ABSTRACT

The present disclosure relates generally to spray systems and, more particularly, to industrial spray coating systems for applying coatings of paint, stain, and the like. Specifically, the disclosed embodiments relate to a spray gun an air cap configured to produce air swirl. For example, in an embodiment, a system is provided that includes a spray coating device. The spray coating device has a liquid passage extending to a liquid outlet configured to output a liquid flow and an air passage extending to a plurality of air outlets configured to output an air flow. The plurality of air outlets is angled to swirl the air flow.

36 Claims, 7 Drawing Sheets

HIGH SWIRL AIR CAP

CROSS-REFERENCE TO RELATED APPLICATIONS

This application claims the benefit of U.S. Provisional Patent Application Ser. No. 61/435,737 entitled "HIGH SWIRL AIR CAP," filed on Jan. 24, 2011, which is herein incorporated by reference in its entirety for all purposes.

BACKGROUND

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The invention relates generally to spray systems and, more particularly, to industrial spray coating systems for applying coatings of paint, stain, and the like. Spray coating devices are used to apply a spray coating to a wide variety of product types and materials, such as wood and metal. The spray coating fluids used for each different industrial application may have much different fluid characteristics and desired coating properties. For example, wood coating fluids (e.g., stains) are generally viscous fluids, which may have significant particulate/ligaments throughout the fluid. Existing spray coating devices, such as air atomizing spray guns, are often unable to breakup such particulate/ligaments to produce a desired coating. That is, the spray coatings that result from insufficient atomization usually have an undesirably inconsistent appearance, which may be characterized by mottling and various other inconsistencies in textures, colors, and overall appearance.

BRIEF DESCRIPTION

The present embodiments may provide improved atomization in spray devices to reduce the incidence of such undesirable particulates and/or ligaments. For example, in one embodiment, a system is provided that includes a spray coating device. The spray coating device has a liquid passage extending to a liquid outlet configured to output a liquid flow, and an air passage extending to a plurality of air outlets configured to output an air flow. The plurality of air outlets is angled to swirl the air flow.

In another embodiment, a system is provided with a spray head component having a plurality of air outlets. The plurality of air outlets has a plurality of air flow axes, wherein the plurality of air outlets is configured to output an air flow along the plurality of air flow axes. The plurality of air outlets is arranged at least partially around a liquid flow axis, and the plurality of air outlets is angled inwardly toward the liquid flow axis without intersecting the liquid flow axis.

In a further embodiment, a system is provided with a spray head component having a central surface with a central opening configured to allow output of a liquid flow along a liquid flow axis. The spray head component also includes a plurality of air atomization outlets disposed about the central opening along the central surface, and a first air horn protruding from the central surface at a first offset distance from the central opening. The first air horn has a first inner surface that curves circumferentially about the liquid flow axis, and the first inner surface has at least one first air shaping outlet. The spray head component also includes a second air horn protruding from the central surface at a second offset distance from the central opening. The second air horn includes a second inner surface that curves circumferentially about the liquid flow axis, and the second inner surface has at least one second air shaping outlet.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
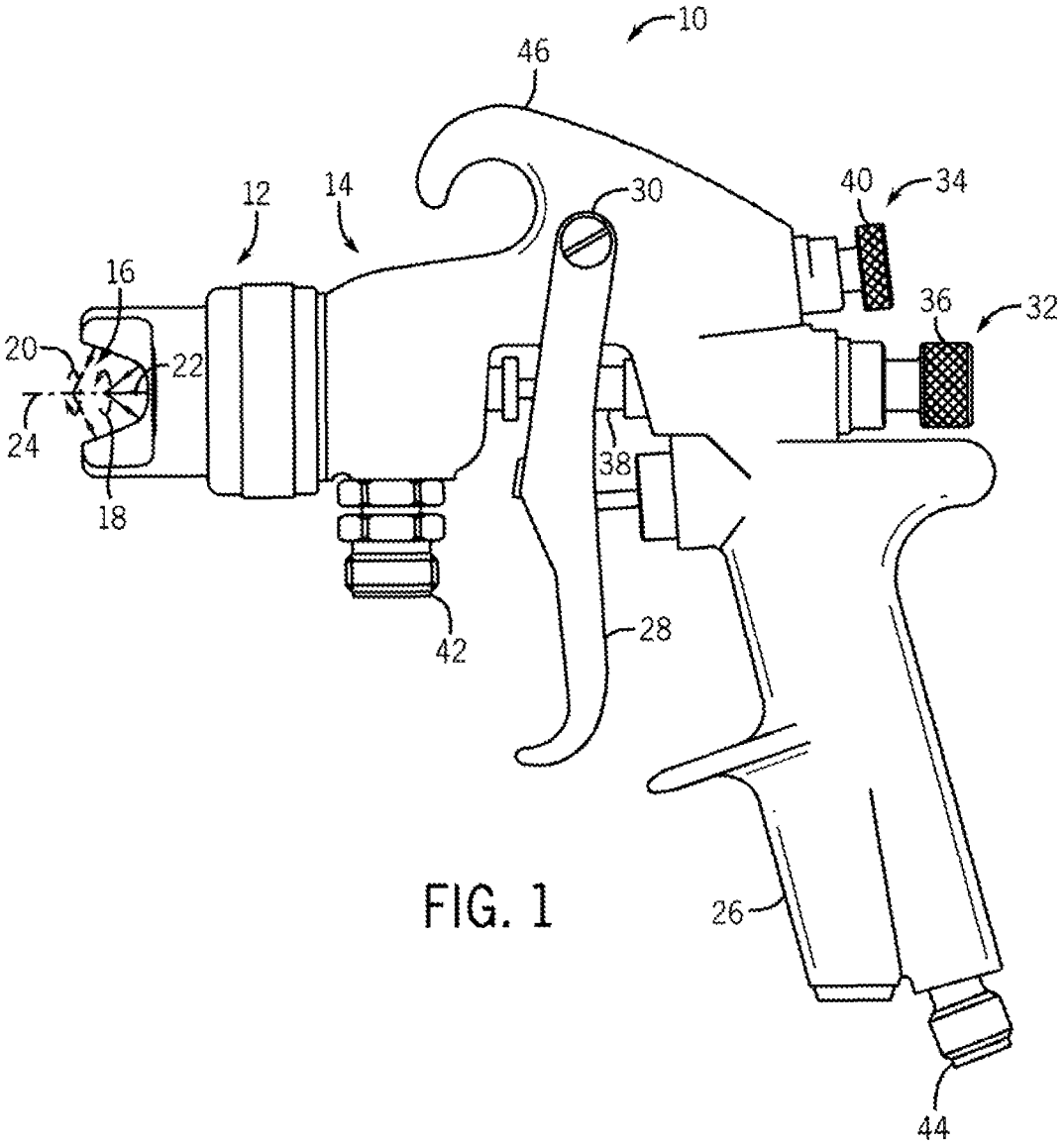
FIG. 1 is a plan view of an embodiment of a spray coating device having a spray head component configured to create air swirl for fluid atomization.

FIG. 1 illustrates an embodiment of a spray coating device 10 that may incorporate various spray-shaping and atomization features in accordance with the presently contemplated embodiments. In the illustrated embodiment, the device 10 includes a spray head component 12 coupled to a body 14 of the spray coating device 10. The spray head component 12 generally includes features for creating swirl in an air flow, as represented by arrows 16. The swirled air flow 16 includes a first directional swirl 18 and a second directional swirl 20. The first directional swirl 18 and the second directional flow 20 may be created by a plurality of angled orifices of the spray head component 12, as will be discussed in detail below with respect to FIGS. 2-6. The first directional swirl 18 is created to improve atomization of a liquid flow 22 that is ejected from the spray coating device 10 along a liquid flow axis 24. The first directional swirl 18 may induce some amount of swirling of the liquid flow 22, which may cause a conical or vortical-shaped fluid ejection that diverges from the liquid flow axis 24. To compensate for such induced swirl, and to create a regular spray shape, the second directional swirl 20, which rotates in an opposing relationship to the first swirl direction 18 with respect to the liquid flow axis 24, flattens the ejected fluid into a flat spray pattern.

It should be noted that the spray head component 12 in accordance with the present embodiments is presented in the context of a combination with the spray coating device 10 to facilitate discussion, and that the discussion of the spray coating device 10 and its components is not intended to limit the scope of the present approaches to air swirling to facilitate fluid atomization and spray shaping. Indeed, the spray head component 12 is combinable with a wide variety of spray coating devices including less than or more features than those presently disclosed. Therefore, keeping the operation of the spray head component 12 in mind, the spray coating device 10 also includes features that facilitate handling and spray triggering by a user, interface with various fluid sources (e.g., paint, water, lacquer, or other liquid coating sources, air sources, and so forth), fluid pressure adjustment, and storage, to name a few.

Specifically, in the illustrated embodiment, the spray coating device 10 includes a handle 26 to facilitate use of the spray coating device 10 by a user. The handle 26 is configured to allow gripping by the user's hand, and is disposed proximate a trigger 28 to allow the user to grip and trigger the spray coating device 10 as needed. The trigger 28 is generally configured to allow the liquid flow 22 to be ejected from the device 10 and also to allow air to flow through the spray head component 12 to form the swirled air flow 16. As an example, the trigger 28 may be coupled to one or more valves that are internal to the spray coating device 10, as will be discussed in further detail with respect to FIG. 2. The trigger 28 is coupled to the body 14 of the device 10 at a pivot joint 30, which hinges the trigger 28 to allow rotational movement when the user pulls the trigger 28 towards the handle 26 and when the trigger 28 is released.

As noted above, the device 10 also includes a liquid adjustment assembly 32 for adjusting liquid flow through the device 10 and an air adjustment assembly 34 for adjusting air flow through the device 10. The liquid adjustment assembly 32 may be coupled to the body 14 of the device 10 by a suitable connection, such as a press-fit, an interference fit, a snap fit, threads, and so on. The liquid adjustment assembly 32, as illustrated, may include a fluid valve adjuster 36 that is configured to move a fluid needle valve 38 between positions to vary fluid flow within the body 14 of the device 10. Similarly, the air adjustment assembly 34 may be coupled to the body 14 via press-fit, an interference fit, a snap fit, threads, and so on. The air adjustment assembly 34 also includes an air valve adjuster 40 that is configured to move an air needle between positions to vary an air flow through the body 14 of the device 10, as will be discussed in further detail below with respect to FIG. 2. The device 10 also includes a fluid inlet coupling 42 for receiving liquid from a liquid source, as well as an air inlet coupling 44 for receiving air (e.g., compressed air) from an air source. When not in use or between sprayings, the device 10 may be stored (e.g., hung) using hook 46.

Figure 2:
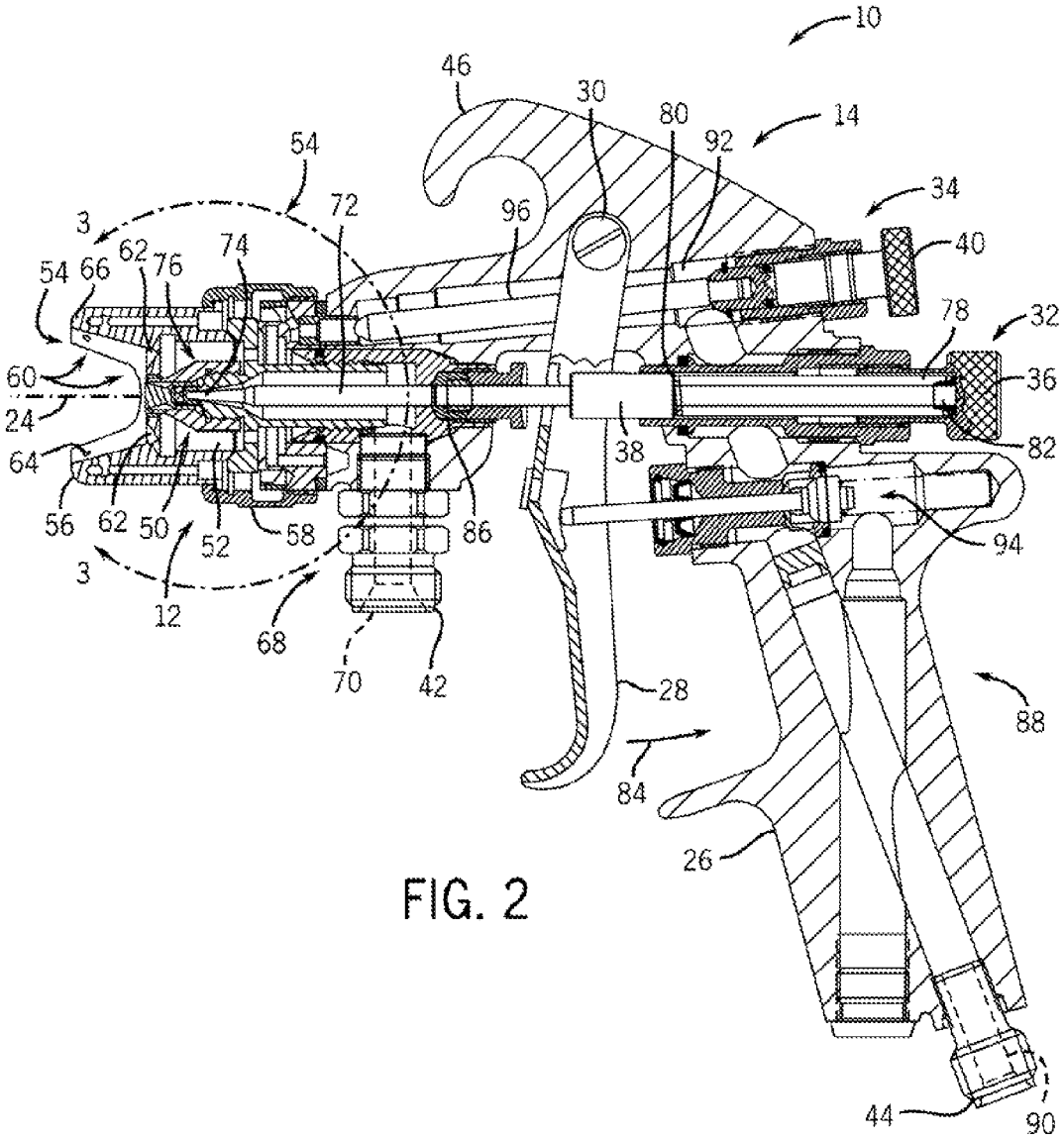
FIG. 2 is a cross-sectional side view of the spray coating device of FIG. 1 illustrating various features for creating and shaping a spray coating.

FIG. 2 is a cross-sectional side view of the spray coating device 10 illustrating various internal features that result in the production of the swirled air flow 16 and the liquid flow 22 that is atomized by the swirled air flow 16. As illustrated, the spray coating device 10 includes the spray head component 12 coupled to the body 14. The spray head component 12 includes a fluid delivery tip assembly 50, which may be removably inserted into a receptacle 52. For example, a plurality of different types of spray coating devices may be configured to receive and use the fluid delivery tip assembly 50. The spray head component 12 also includes a spray formation assembly 54 coupled to the fluid delivery tip assembly 50. The illustrated spray formation assembly 54 includes an air atomization cap 56, which in some embodiments may be removably secured to the body 14 of the device 10 via a threaded retaining nut 58. In other embodiments, the air atomization cap 56 may be secured to the body 14 via a snap fit, an interference fit, a press fit, bolts, clamps, and so forth.

The air atomization cap 56 includes a plurality of air outlets 60 disposed in a curved arrangement about the liquid flow axis 24. The plurality of air outlets 60 are generally configured to atomize and/or shape the spray exiting the spray coating device 10. The plurality of air outlets 60 includes a first plurality of air outlets 62 and a second plurality of air outlets 64. The first plurality of air outlets 62 are configured to create the first directional swirl 18 (FIG. 1) to atomize the liquid flow 22 as the device 10 is activated (e.g., triggered). Embodiments of the first plurality of air outlets 62 are discussed in further detail below. The second plurality of air outlets 64 are disposed on air horns 66 that extend away from the body 14 of the spray coating device 14 and diverge away the liquid flow axis 24. While the illustrated embodiment depicts the device 10 as including two air horns 66, it should be noted that the number of air horns 66 may be increased or decreased, as will be discussed in further detail with respect to FIG. 4. In accordance with presently contemplated embodiments, the second plurality of air outlets 64 are configured to generate the second directional swirl 20 discussed above with respect to FIG. 1. The spray formation assembly 54 also may include other atomization mechanisms to provide a desired spray pattern and droplet distribution.

The body 14 of the spray coating device 12 includes a variety of controls and supply mechanisms for the spray head component 12. As illustrated, the body 14 includes a fluid delivery assembly 68 having a fluid passage 70 extending from the fluid inlet coupling 42 to the fluid delivery tip assembly 50. The fluid delivery assembly 68 also includes a fluid valve assembly 72 to control fluid flow through the fluid passage 70 and to the fluid delivery tip assembly 50. The illustrated fluid valve assembly 72 includes the fluid needle valve 38 extending movably through the body 14 between the fluid delivery tip assembly 50 and the fluid valve adjuster 36. The fluid needle valve 38 includes a tip portion 74 that protrudes into a removable nozzle and pintle assembly 76. As will be discussed in further detail below, the nozzle and pintle assembly 76 includes features that, in conjunction with the tip portion 74, control the flow of liquid through the fluid tip delivery assembly 50. The fluid valve adjuster 36 is rotatably adjustable against a spring 78 disposed between a rear section 80 of the fluid needle valve 72 and an internal portion 82 of the fluid valve adjuster 36. The fluid needle valve 72 is also coupled to the trigger 28, such that the fluid needle valve 72 may be moved inwardly away from the fluid delivery tip assembly 50 as the trigger 28 is rotated in a first direction 84 (e.g., counterclockwise with respect to FIG. 2) about the pivot joint 30. However, any suitable inwardly or outwardly openable valve assembly may be used within the scope of the presently contemplated embodiments. The fluid valve assembly 72 also may include a variety of packing and seal assemblies, such as packing assembly 86, disposed between the fluid needle valve 72 and the body 14.

An air supply assembly 88 is also disposed in the body 14 to facilitate atomization at the spray formation assembly 54. The illustrated air supply assembly 88 extends from the air inlet coupling 44 to the air atomization cap 56 via air passages 90 and 92. The air supply assembly 88 also includes a variety of seal assemblies, air valve assemblies, and air valve adjusters to maintain and regulate the air pressure and flow through the spray coating device 12. For example, the illustrated air supply assembly 88 includes an air valve assembly 94 coupled to the trigger 28, such that rotation of the trigger 28 about the pivot joint 30 (e.g., in the first direction 84) opens the air valve assembly 94 to allow air flow from the air passage 90 to the air passage 92. The air supply assembly 88 also includes the air valve adjustor 40 coupled to an air needle 96, such that the needle 96 is movable via rotation of the air valve adjustor 40 to regulate the air flow to the air atomization cap 56. As illustrated, the trigger 28 is coupled to both the fluid valve assembly 72 and the air valve assembly 88, such that fluid and air flow in concert to the spray head component 12 as the trigger 28 is pulled toward the handle 26 of the body 14. The air and the liquid (e.g., liquid paint or other coating) may flow through the body 14 substantially simultaneously, or one fluid may flow through the body 14 prior to the flow of the other fluid, for example using timing features incorporated into the trigger 28. For example, in one embodiment, the fluid may begin flowing through the body 14 prior to the flow of air. Indeed, any timing configuration of the trigger 28 may be utilized in accordance with the disclosed embodiments. As discussed in detail below, once engaged (e.g., triggered), the spray coating device 12 produces an atomized spray with a desired spray pattern and droplet distribution. Again, the illustrated spray coating device 12, as discussed herein, is provided as one embodiment of the disclosed air swirl features. Any suitable type or configuration of a spraying device may benefit from providing an atomizing and/or spray shaping air swirl in accordance with the presently contemplated embodiments.

Figure 3:
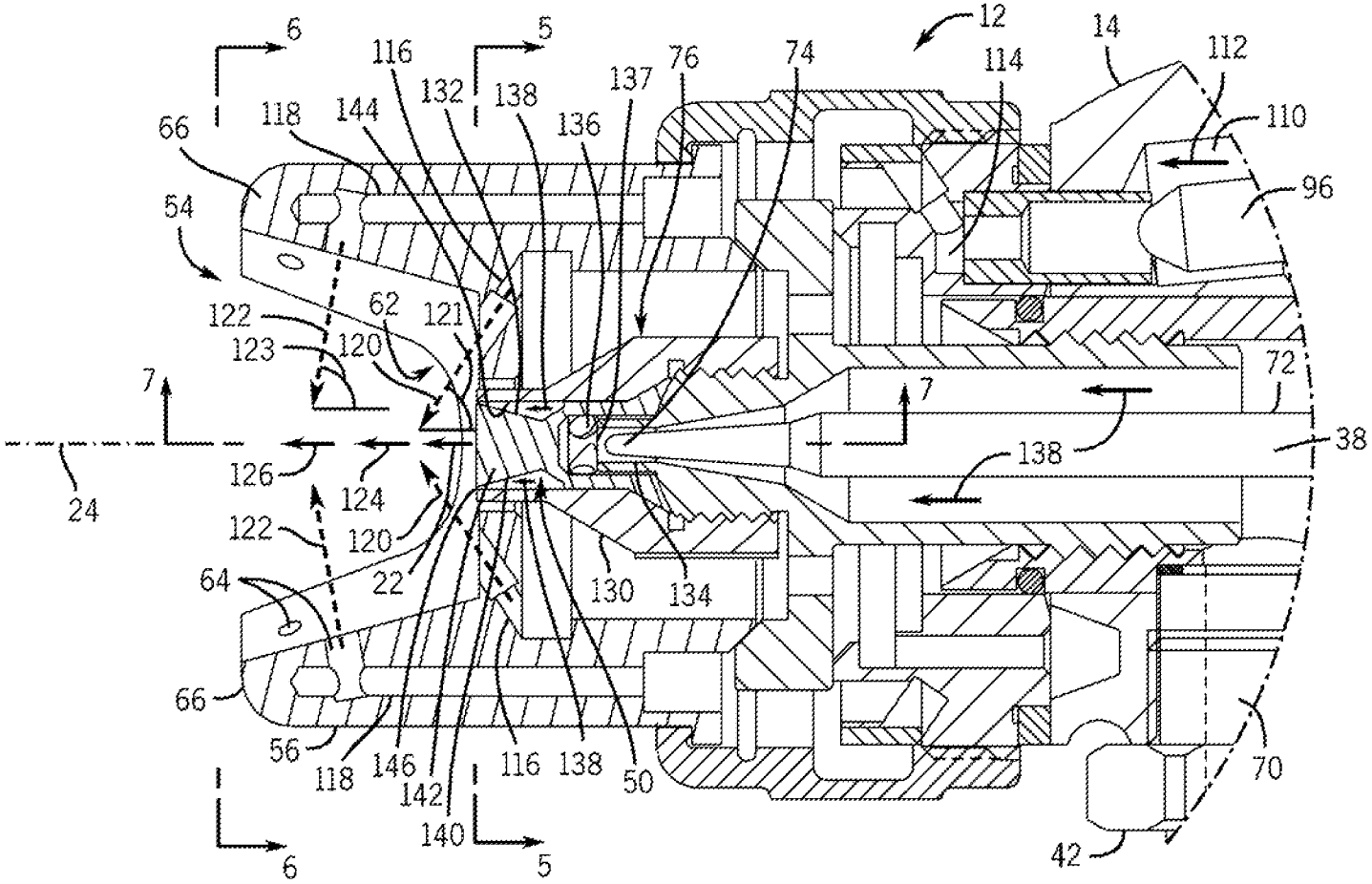
FIG. 3 is a partial cross-sectional side view of an embodiment of the spray head component of FIGS. 1 and 2 taken within line 3-3.

FIG. 3 is a partial cross-sectional side view of an embodiment of the spray head component of FIGS. 1 and 2 taken within line 3-3. In particular, FIG. 3 illustrates various features of the spray head component 12 that are configured to produce an atomizing and spray-shaping air swirl. As illustrated, the needle 96 of the air supply assembly 88 (FIG. 2) and the fluid needle valve 38 of the fluid valve assembly 72 are both partially open, such that air and fluid passes through the spray head component 12 to generate an atomized spray. Specifically, turning first to the features of the air supply assembly 88, the air flows through an air passage 110 about the needle 96 as indicated by arrow 112. The air then flows through the body 14 and into a central air passage 114 that diverges to a first set of air passages 116 and a second set of air passages 118 that lead to the first plurality of air holes 62 and the second plurality of air holes 64, respectively. The air then exits the first and second plurality of air holes 62, 64 to generate at least a first air flow, as depicted by arrows 120, exiting the first plurality of air holes 62, and a second air flow, depicted by arrows 122 exiting the second plurality of air holes 64. In accordance with certain embodiments, the first air flow 120 generates the first directional air swirl 18 and the second air flow 122 generates the second directional air swirl 20. The first directional swirl 18, and thus the first air flow 120, impinges on the liquid flow 22 radially inward and toward the liquid flow axis 24 at a first angle 121. As an example, the first angle 121 may be between about 1° and about 65° relative to the axis 24 (e.g., 1°, 5°, 10°, 25°, 45°, 50°, 55°, or 65° from the axis 24) with respect to the oncoming liquid flow 22. However, as discussed below, the first plurality of air holes 62 direct the first plurality of air flows 120 at an offset form the liquid flow axis 24 to generate the first directional swirl 18. This results in swirling and atomization of the liquid flow 22 exiting the air atomization cap 56 (i.e., external to the spray coating device 10) to generate an atomized coating spray 124. Because the first plurality of air holes 62 are angled so as to not intersect the liquid flow axis 24, the atomized coating spray 124 may not be entirely flat (i.e., may be swirled). The second directional swirl 20, and thus the second air flow 122, impinges on the atomized coating spray 124 at a second angle 123 with respect to the liquid flow axis 24. It should be noted that in some embodiments, the first and second angles 121, 123 may be the same, while in other embodiments, the first and second angles 121, 123 may be different. For example, the second angle 123 may be between about 1° and about 85° relative to and offset from the liquid flow axis 24 (e.g., 1°, 5°, 10°, 25°, 45°, 50°, 55°, 65°, 75°, or 85° from the axis 24) with respect to the oncoming atomized coating spray 124. The second air flow 122 generates a flat coating spray 126, as noted above, by swirling the second directional air flow 20 in an opposing relationship to the first swirled air flow 18. However, in other embodiments, the second directional air flow 20 may be oriented in the same general direction as the first swirled air flow 18. In some embodiments, the second air flow 122 may also provide further atomization of the atomized coating spray 124.

Turning to the fluid flow through the device 10, the fluid delivery tip assembly 50 includes the nozzle and pintle assembly 76, which includes a sleeve 130 (e.g., a nozzle) disposed about a central member or pintle 132. The illustrated pintle 132 includes a central fluid passage or preliminary chamber 134, which leads to one or more restricted passageways or supply holes 136. These supply holes 136 can have a variety of geometries, angles, numbers, and configurations (e.g., symmetrical or non-symmetrical) to adjust the velocity, direction, and flow rate of the fluid flowing through the fluid delivery tip assembly 50. For example, in certain embodiments, the pintle 132 may have the supply holes 136 disposed symmetrically about the liquid flow axis 24. In operation, when the needle valve 38 is open (i.e., the tip 74 is retracted away from an inner surface 137 of the nozzle and pintle assembly 76), a desired fluid (e.g., paint) flows through fluid passage 70, about the needle valve 38 of the fluid valve assembly 72, as indicated by arrows 138. The fluid then flows into the central fluid passage or preliminary chamber 134 of the pintle 132. As indicated by arrow 138, the supply holes 136 then direct the fluid flow from the preliminary chamber 134 into a secondary chamber or throat 140, which is defined as the space between a forward tip section 142 of the pintle 132 and an inner surface 144 of the sleeve 130. The fluid flow 22 then exits the body 14 of the device 10 via a fluid tip exit 146 (e.g., a liquid outlet) of the nozzle and pintle assembly 76 along the fluid flow axis 24.

In some embodiments, the sleeve 130 and the pintle 132 may have a configuration that results in a geometry of the throat 140 that diverges and converges toward the fluid tip exit 146. During operation of such embodiments, these diverging and converging flow pathways may induce fluid mixing and breakup prior to air atomization and shaping by the air flows 120 and 122. For example, successive diverging and converging flow passages can induce velocity changes in the fluid flow, thereby inducing fluid mixing, turbulence, and breakup of particulate that may be present in the liquid. Moreover, the fluid dynamics (e.g., viscosity, particulate concentration, and so on) of a given liquid may at least partially influence the particular configuration of the nozzle and pintle assembly 76. Accordingly, the nozzle and pintle assembly 76 in accordance with presently contemplated embodiments is swappable (i.e., removable and replaceable) with other assemblies having differing sizes, shapes, and/or extents of the holes 136 and/or throat 140 to suit a particular coating application.

Figure 4:
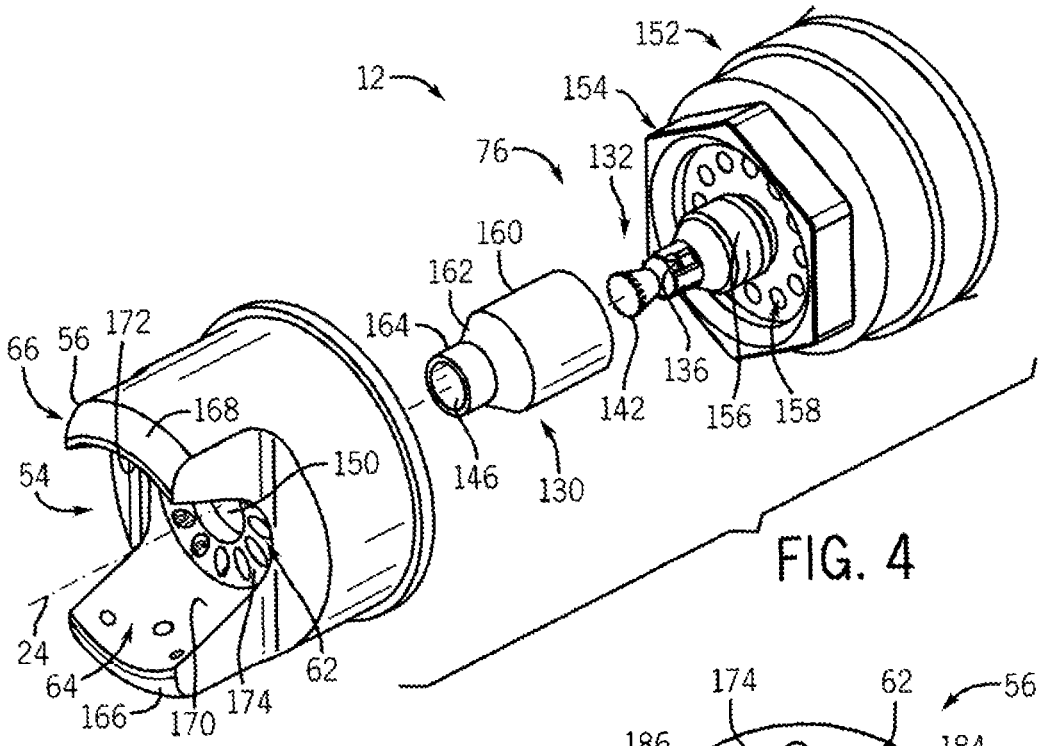
FIG. 4 is an exploded perspective view of an embodiment of the spray head component of FIGS. 1-3 and separately illustrating embodiments of an air cap, a nozzle, and a pintle assembly of the spray head component.

FIG. 4 is an exploded perspective view of an embodiment of the spray head component of FIGS. 1-3 and separately illustrating various components of the spray head component 12. Specifically, the air cap 56 configured to produce the air swirls, the sleeve 130, and the pintle 132 are illustrated as separated along the liquid flow axis 24. In accordance with presently contemplated embodiments, the air cap 56 and the nozzle and pintle assembly 76 may be removable from the body 14 of the device 10 without special tools or equipment due to their facile manipulation with widely available tools (e.g., wrenches or pliers). Alternatively, in some embodiments, the air cap 56 and/or the nozzle and pintle assembly 76 may be removed by hand. Accordingly, the illustration of FIG. 4 depicts the separation of the components of the nozzle and pintle assembly 76 from the air cap 56 that may occur during cleaning or replacement operations. The air cap 56, which is removable in addition to the nozzle and pintle assembly 76, includes a central opening 150 oriented coaxially with the liquid outlet 146 of the sleeve 130. This allows the liquid flow 22 to exit the device proximate and central to the plurality of first air holes 62 to facilitate atomization. In this way, the air flow is not collinear with the liquid flow, but rather impinges the liquid flow from a plurality of discrete locations (e.g., air holes 62 and 64) for atomization and spray shaping. The pintle 132 is illustrated as connected to a rear portion 152 of the spray head component 12, and has the forward tip section 142 aligned coaxially with the liquid outlet 146 of the sleeve 130 and the central opening 150 of the air cap 56.

The pintle 132, as noted above, includes the plurality of orifices 136 and the forward tip portion 142 that interfaces with the liquid outlet 146 of the sleeve 130, both of which allow liquid to flow through the nozzle and pintle assembly 76 and out of the device 10 in a controlled manner. In the illustrated embodiment, the liquid outlet 146 is a circular opening, as opposed to an ellipsoidal opening (e.g., a cat-eye opening). However, the use of a cat-eye opening as the liquid outlet 146 is also contemplated herein. Additionally, the pintle 132 includes a rear section 154 having a nozzle portion 156 extending through at least a part of the body 14 of the device 10. The nozzle portion 156 is also removable from the body 14, for example, by pulling on the nozzle portion 156 in a direction away from the body 14. The rear section 154 also includes a plurality of air holes 158 that direct air towards the first plurality of air holes 62 of the air cap 56.

The sleeve 130, as illustrated, includes a first cylindrical section 160, a tapered section 162, and a second cylindrical section 164. The first cylindrical section 160 is generally configured to receive the nozzle portion 156 of the pintle 132, for example to secure the pintle 132 within the air cap 56 and/or the body 14 of the spray coating device 10. The first cylindrical section 160 tapers to the second cylindrical section 164 via the tapered section 162, which generally has a frusto-conical shape to reduce the inner diameter of the sleeve 130 to form a suitable size for the throat 140, which, as noted above, is defined as the cavity between the sleeve 130 (i.e., the second cylindrical section 164) and the forward tip portion 142 of the pintle 132 when the nozzle and pintle assembly 76 is assembled.

As noted above, the air cap 56 includes a plurality of air holes, specifically a first plurality of air holes 62 configured to produce the first directional air swirl 18, and a second plurality of air holes 64 disposed on air horns 66, the second plurality of air holes 64 being configured to produce the second directional air swirl 20. Specifically, in the illustrated embodiment, the air cap 56 includes a first air horn 166 and a second air horn 168 protruding away from the body 14 of the device 10 and having respective second pluralities of air holes 64. The first air horn 166 and the second air horn 168 are disposed at opposite diametrical extents of the air cap 56 and face one another. Specifically, the first air horn 166 includes a first inner surface 170 (e.g., a concave surface) that curves circumferentially about the liquid flow axis 24 of the central opening 150, which may be considered the liquid opening of the air cap 56. Similarly, the second air horn 168 includes a second inner surface 172 (e.g., a concave surface) that curves circumferentially about the liquid flow axis 24 of the central opening 150. The second plurality of air outlets 64 is disposed on the curved first and second inner surfaces 170, 172. In accordance with certain presently contemplated embodiments, the curved geometry of the first and second inner surfaces 170, 172 may facilitate interaction with and/or flattening of the swirling, atomized coating spray 124. For example, the curved surfaces 170, 172 help direct the second directional air swirl 20 radially inward towards the atomized coating spray 124 and against the first directional air swirl 18.

The second plurality of air outlets 64 may be any size and/or shape to the extent that they are disposed on the respective inner surfaces of the air horns 66. As will be appreciated with respect to the illustrated embodiment, the second plurality of air outlets 64 are angled relative to one another as a result of the concave shape of the surfaces on which they are disposed. However, as will be described in further detail with respect to FIG. 6, each of the second plurality of air outlets 64 may be angled non-perpendicular relative to its respective surface and/or the liquid flow axis 24. In other words, the air flow 122 (FIG. 3) is not normal to the surface at each of the air outlets 64. In this way, each of the second plurality of air outlets 64 is angled with respect to the direction of the atomized coating spray 124 (i.e., the liquid flow axis 24), as well as angled relative to their respective surfaces. As an example, the air outlets 64 may be angled by between about 1° and about 85° relative to and offset from the liquid flow axis 24 (e.g., 1°, 5°, 10°, 25°, 45°, 50°, 55°, 65°, 75°, or 85° from their respective surfaces and relative to the liquid flow axis 24). As such each of the second plurality of air outlets 64 may be considered as having a compound angular geometry.

Figure 5:
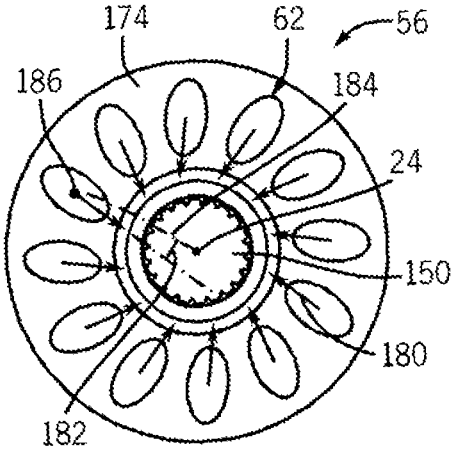
FIG. 5 is a front axial view of an embodiment of a front face of the air cap taken along line 5-5 of FIG. 3, illustrating an air swirl created by a plurality of angled openings of the face.

In a similar manner to the second plurality of air outlets 64, the first plurality of air outlets 62 each have a compound angular geometry, and are disposed on a central surface 174 of the air cap 56. That is, each of the first plurality of air outlets 62 are angled relative to their respective surfaces as well as angled relative to the liquid flow axis 24. As an example, the air outlets 64 may be angled by between about 1° and about 85° relative to and offset from the liquid flow axis 24 (e.g., 1°, 5°, 10°, 25°, 45°, 50°, 55°, 65°, 75°, or 85° from their respective surfaces and relative to the liquid flow axis 24). The compound angular geometry of the first plurality of air outlets 62, in accordance with present embodiments, creates a swirling action of atomizing air, which facilitates particulate breakup as well as homogenization of the liquid flow 22 exiting the device 10. FIG. 5 is a front axial view of an embodiment of the front surface 174 of the air cap 56 taken along line 5-5 of FIG. 3.

In the illustrated embodiment, the first plurality of air outlets 62 has a plurality of air flow axes, represented generally as arrows 180. The first plurality of air outlets 62, as noted above, are each configured to output an air flow along their respective air flow axes 180. In the illustrated embodiment, the first plurality of air outlets 62 is arranged symmetrically and circumferentially about the liquid flow axis 24 such that the first plurality of air outlets 62 completely surround the central opening 150 of the air cap 56. In other embodiments, the first plurality of air outlets 62 may be arranged partially about the liquid flow axis 24. In other words, the first plurality of air outlets 62 may or may not completely surround the central opening 150. In accordance with certain presently contemplated embodiments, the first plurality of air outlets 62 is angled radially inward toward the liquid flow axis 24 without intersecting the liquid flow axis 24.

For example, the respective air flow axes 180 of the first plurality of air outlets 62 do not align with the center of the central opening 150, which corresponds to the liquid flow axis 24. In this way, the air flow axes 180 each do not bisect the central opening 150. Indeed, to allow the first plurality of air outlets 62 to swirl air, and therefore the liquid flow 22, each of the first plurality of air outlets 62 is offset at an angle 182 from a radius 184 of the central opening 150. The respective angles 182 of each of the first plurality of air outlets 62 may be the same, or may be different, and may vary between about 1° and 25° offset from radii aligning the liquid flow axis 24 and the respective centers 186 of each of the air outlets 62. For example, the angle 182 may be about 1°, 5°, 10°, 11.5°, 15°, 20°, or 25°, or any angle in between. Moreover, while the first plurality of air outlets 62 is illustrated as including 12 air outlets, in other embodiments the first plurality of air outlets 62 may include 2, 4, 6, 8, 10, 14, or more outlets. Indeed, any number of air outlets 62 configured to produce a swirling effect on the liquid flow 22 as it exits the device 10 is presently contemplated.

While any number of the first plurality of air outlets 62 may be used in accordance with the presently contemplated embodiments, it should be noted that the size of each first plurality of air outlets 62 may at least partially determine a suitable number of the air outlets 62, in addition to the angle 182 that is used for air swirling. While the first plurality of air outlets 62 may each have the same or different dimensions, as an example of certain embodiments, the diameter of each of the first plurality of air outlets 62 may be between about 0.005 inches (in) and about 0.05 in (e.g., about 0.01 in, 0.02 in, 0.03 in, 0.04 in, or 0.05 in). Indeed, the total atomization area for the first plurality of air outlets 62 may be between about 0.01 $in^2$ and 0.05 $in^2$ (e.g., about 0.005 in, 0.01 $in^2$, 0.02 $in^2$, 0.03 $in^2$, 0.04 $in^2$, or 0.05 $in^2$). For example, in one embodiment wherein the air cap 56 has 12 of the first air holes 62, the area of atomization may be about 0.015 $in^2$, with each of the air holes 62 having a diameter of about 0.039 in. It should be noted that while FIGS. 4-6 appear to present the air openings 62 in an ellipsoidal geometry, the orifices (the first plurality of holes 62) from which the atomizing air exits are indeed circular orifices when viewed from a perpendicular perspective with respect to the angled air flow 120 of each of the openings 62.

Figure 6:
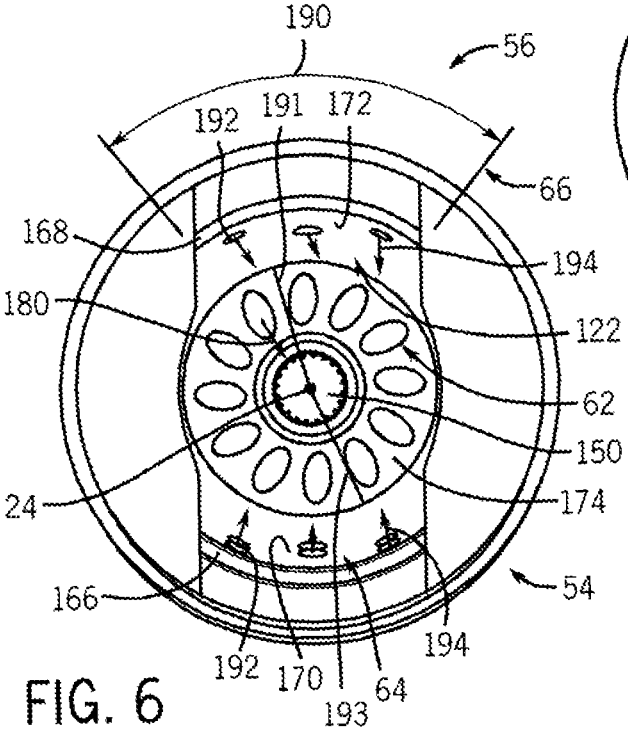
FIG. 6 is a front axial view of the air cap taken along line 6-6 of FIG. 3.

FIG. 6 illustrates a front axial view of the air cap taken along line 6-6 of FIG. 3. Referring to the air horns 66 and the relative size of the first plurality of air openings 62 compared to the second plurality of air openings 64, the first plurality of air openings 62 may each be smaller than each of the second plurality of air openings 64 by about 5%, 10%, 15%, 25%, 50%, 75%, 100%, 150%, 200%, or more. In some embodiments, the particular size relationship between the first air openings 62 and the second air openings 64 may also be determined by the number of first openings 62, the number of second openings 64, as well as the desired area of atomizing air for the first openings 62 and the desired area of spray shaping air for the second openings 64. For example, the total area of the first openings 62 may be about the same as the total area of the second openings 64, or may be about 1%, 5%, 10%, 15%, 20%, 50%, 100%, or more, larger than the second openings 64. In other embodiments, the second openings 64 may be about 1%, 5%, 10%, 15%, 20%, 50%, 100%, or more, larger than the first openings 62.

In some embodiments, the size, shape, and extent of the second plurality of air openings 62 may be at least partially determined by the extent to which the air horns 66 surround the central opening 150. As noted above, the second plurality of air outlets 64 may be any size and/or shape to the extent that they are disposed on the respective inner surfaces of the air horns 66. In the illustrated embodiment, the first air horn 166 protrudes from the central surface 174 of the air cap 56 at a first offset distance 191 away from the center of the central opening 150. The second air horn 168 also protrudes from the central surface 174 and is disposed at a second offset distance 193 away from the central opening 150. The first offset distance and the second offset distance 191, 193 may be substantially the same for both air horns 166, 168, and may be substantially continuous from the central opening to the air horns 166, 168 due to their curved geometry. However, in other embodiments, the distances 191, 193 may be different. The extent that each of the curved air horns 166, 168 curve about the liquid flow axis 24 (or the central opening 150), as represented by arc 190, may range from about 1° to about 180° (e.g., about 10° to about 160°, about 20° to about 140°, about 30° to about 100°, or about 40° to about 80°) around the circumference of the air cap 56. In some embodiments, the arc 190 may be between about 25° to about 60° For example, the arc 190 may be 25°, 30°, 40°, 50°, 60°, or any angle in therein.

The extent of arc 190, as well as the number, sizing, and angles of the second plurality of air outlets 64 may at least partially determine the manner in which the air flow 122 flattens the atomized coating spray 124 described above with respect to FIG. 2. For example, in the illustrated embodiment, the first and second air horns 166, 168 each include three air openings 192 that produce the air flow 122 along respective air flow axes, which is represented as arrows 194. The air flow 122, as noted above, produces swirled air that is countercurrent to the swirled air produced by the first plurality of air holes 62. This results in the flattening effect described above, as well as additional atomization of the liquid.

Figure 7:
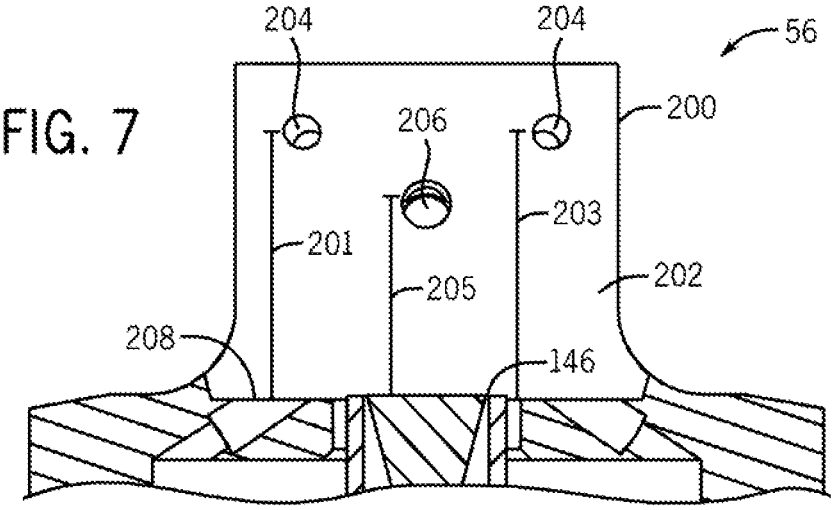
FIG. 7 is a partial cross-sectional view of an embodiment of an air horn of the spray head component taken along line 7-7 of FIG. 4.
Figure 8:
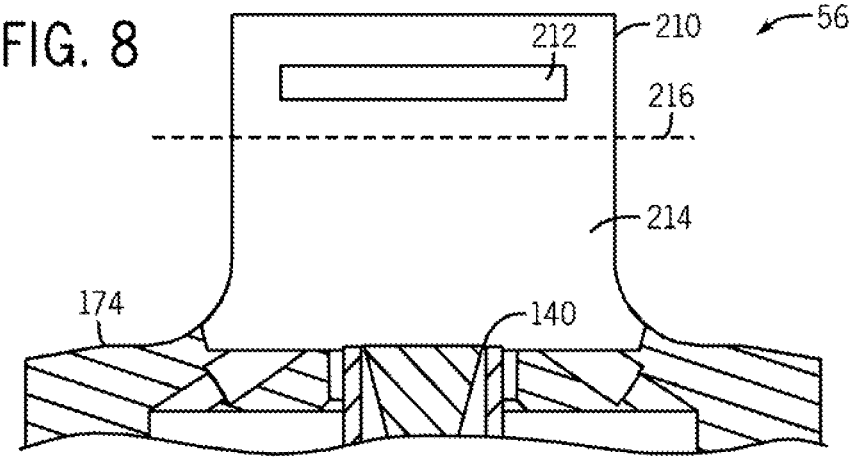
FIG. 8 is a partial cross-sectional view of another embodiment of an air horn of the spray head component taken along line 7-7 of FIG. 4.

Various configurations of air outlets of the air horns 66 may be further appreciated with respect to FIGS. 7 and 8, which are partial cross-sectional views of embodiments of an air horn of the spray head component taken along line 7-7 of FIG. 4. Specifically, FIG. 7 illustrates an embodiment of an air horn 200 having a curved inner surface 202 (e.g., a concave surface) with a pair of first spray shaping outlets 204 and a second spray shaping outlet 206. As illustrated, the outlets 204 surround the outlet 206. In accordance with the illustrated embodiment, the spray shaping outlets 204, 206 are not aligned with respect to their respective distances 201, 203, 205 away from a lower portion 208 of the air horn 200, which is generally aligned with the liquid opening 146. However, in other embodiments, the spray shaping outlets 204, 206 may be substantially aligned (i.e., have substantially the same distance 201, 203, 205 away from the lower portion 208).

In other configurations, the air outlets 64 of the air horns 66 may be replaced by one or more slots. FIG. 8 illustrates a partial cross-sectional view of another embodiment of an air horn of the spray head component taken along line 7-7 of FIG. 4. Specifically, FIG. 8 depicts an air horn 210 having a spray shaping air slot 212 disposed on a curved inner surface 214 (e.g., a concave surface). In a similar manner to the arrangement of the air outlets 64, 204, and 206 described above, the air slot 212 extends in a crosswise direction 216 that is substantially parallel to the central surface 174 of the air cap 56. In still further embodiments, the air horns 66 may include any number and/or combination of air slots and air openings having a variety of shapes and sizes. For example, the air openings on the air horns 66 may be ellipsoidal, rectangular, square, triangular, polygonal, and so on, with swirling occurring at least partially due to the curvature of the inner surfaces of the air horns 66. Indeed, all such combinations are presently contemplated with respect to the formation of one or more swirled air flows to induce liquid atomization, or homogenization, or spray shaping, or any combination thereof.

As noted above, it may be desirable to incorporate feature that facilitate the use of the air cap configured to swirl air in conjunction with a variety of spray devices. For example, it may be desirable to provide an air cap in accordance with the presently contemplated embodiments that has the capability to receive a variety of geometries (e.g., shapes, and sizes) and configurations of valves, liquid outlets and internal flow patterns. One embodiment may include a relatively small liquid outlet for some spray coating applications (e.g., stains), while another embodiment may include a larger liquid outlet for other spray coating applications (e.g., epoxies), each of which may use different fluid seats. Accordingly, the disclosed embodiments provide interchangeable inserts configured for use with the air cap disclosed herein, which facilitates the use of different coating fluids.

Figure 9:
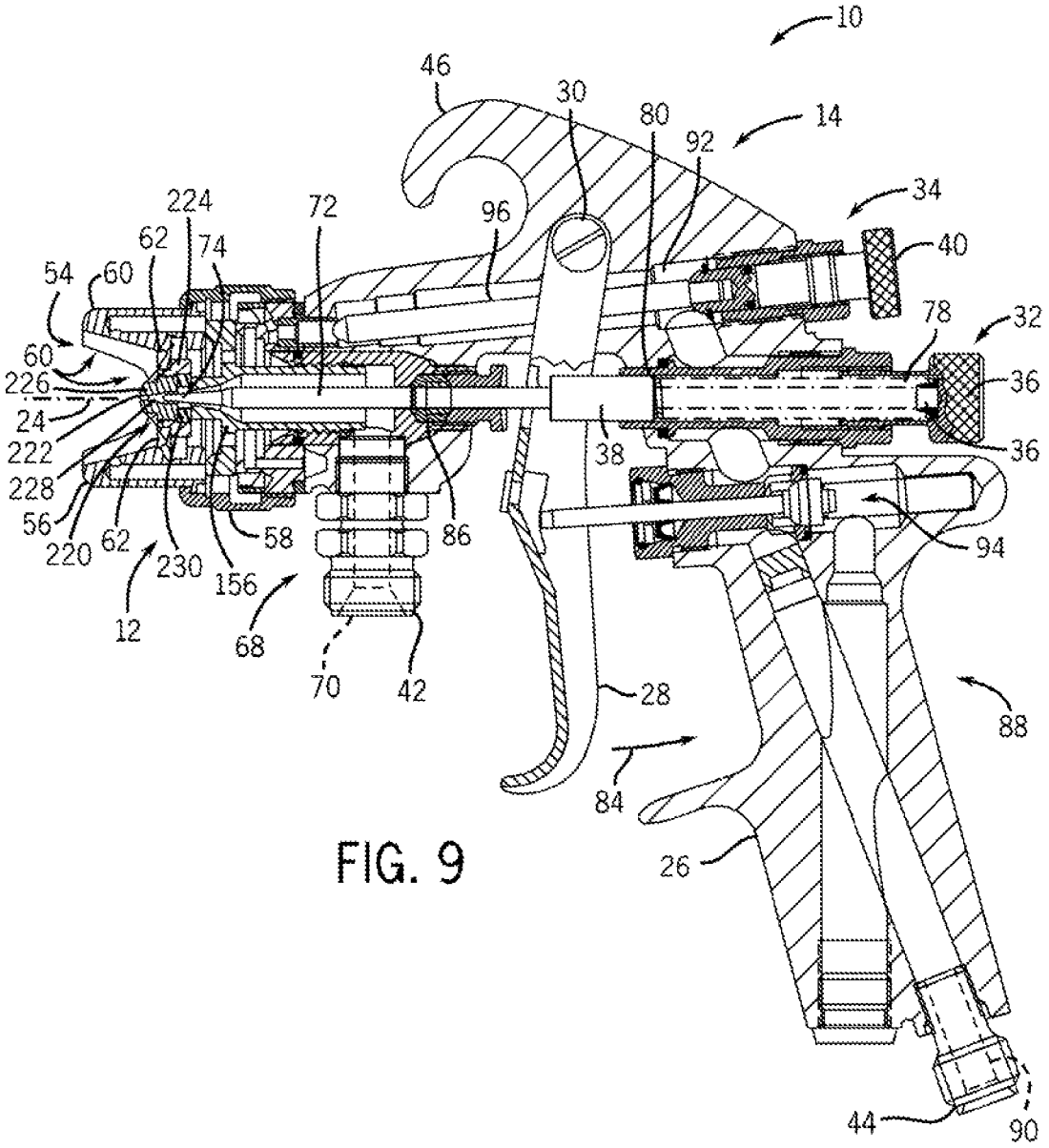
FIG. 9 is a cross-sectional side view of the spray coating device of FIG. 1 illustrating an embodiment of an air cap having a removable liquid nozzle.

With reference now to FIG. 9, a side cross-sectional view of an embodiment of the spray coating device 10 is provided with the air cap 56 having a removable fluid tip and seat assembly 220. The fluid tip and seat assembly 220, in a general sense, may be varied to allow a user to vary the size of a liquid outlet 222. For example, the fluid tip and seat assembly 220 includes a removable tip housing 224 configured to abut the air cap 56, as will be discussed below. The tip housing 224 interfaces with a removable insert 226, which is disposed within an inner circumference of the tip housing 224 and is placed in abutment with the same. Although the tip housing 224 and insert 226 are separate pieces in the illustrated embodiment, the housing 224 and insert 226 may be provided as a single piece in some embodiments.

The insert 226 may be a generally annular structure configured to be disposed within the tip housing 224, and may extend through the tip housing 224 to a certain offset, or may be flush with the tip housing 224. The insert 226, proximate the center of its annular structure, includes the liquid outlet 222. The liquid outlet 222 is generally an opening of the insert 226 having a geometry (e.g., shape and size) tailored to a particular application. For example, as discussed above, the liquid outlet 222 may have a diameter that at least partially depends on the fluid that will be utilized for a particular spray coating application (e.g., stains, paints, epoxies). The insert 226 also includes an inner surface 228 that begins at an inner extent of the insert 226 and tapers into the liquid outlet 222. The tapered inner surface 228 is configured to interface with the liquid needle valve 74, which provides adjustability of liquid flow through the fluid tip and seat assembly 220. Moreover, the tapered inner surface 228 enables the insert 226 to be used in conjunction with a variety of liquid needle valves. Additionally, the tapered liquid needle valve 74 may be used in conjunction with similar inserts having a variety of sizes of the liquid outlet 222. The fluid tip and seat assembly 220 also includes an annular member 230 disposed in abutment with the insert 226. The annular member 230 may facilitate the interface of the fluid tip and seat assembly 220 with the nozzle portion 156 described above with respect to FIG. 4.

Figure 10:
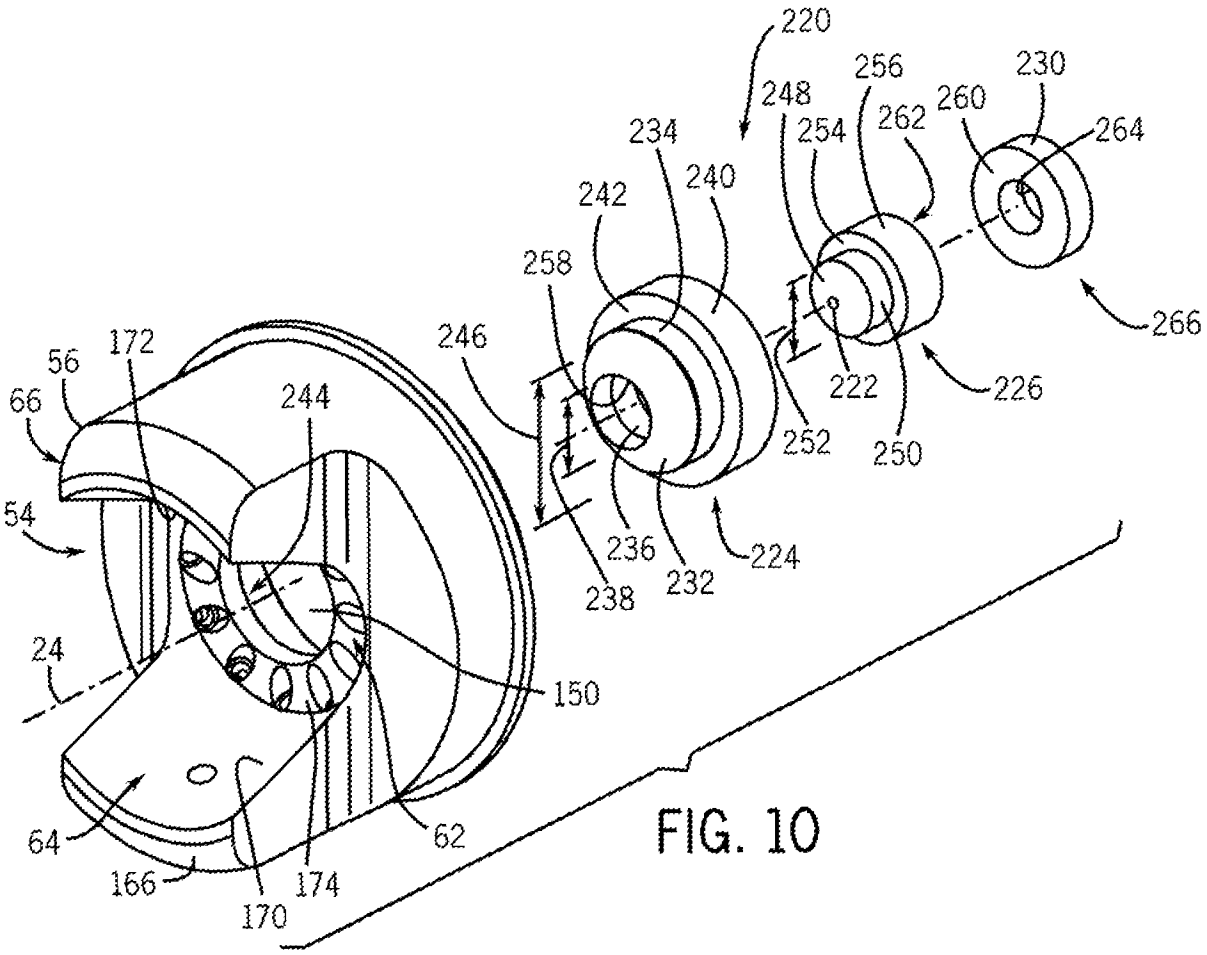
FIG. 10 is an exploded perspective view of an embodiment of the spray head component of FIGS. 1 and 9 and separately illustrating embodiments of an air cap, a nozzle, and a fluid seat of the spray head component.

FIG. 10 illustrates an exploded view of the components of the fluid tip and seat assembly 220, each of the components being disposed along the liquid flow axis 24. In the illustrated embodiment, the fluid tip and seat assembly 220 is exploded from the assembly 220 in an order of installation into the air cap 56. For example, the air cap 56 may sequentially receive the tip housing 224, the insert 226, and the annular member 230. The tip housing 224 can be made from any number of materials including stainless steel, tungsten carbide, delrin-type plastic, or any combination thereof. The tip housing 224 includes a forward tapered surface 232 having a frusto-conical shape extending from a first annular portion 234. The tapered surface 232 opens to a central orifice 236 having a diameter 238 that facilitates an interface between the insert 226 and the tip housing 224, as will be discussed below. The tip housing 224 also includes a second annular portion 240 disposed on an opposite side of the tip housing 224 from the tapered surface 232. The second annular portion 240 includes a forward abutment surface 242 that abuts an inner surface 244 of the air cap 56 when the fluid tip and seat assembly 220 is placed into the air cap 56. Moreover, the first annular portion 234 of the tip housing 224 has a diameter 246 that allows the forward portion of the tip housing 224 to extend through the central opening 150 of the air cap 56 while placing the forward abutment surface 242 against the inner surface 244 of the air cap 56.

The insert 226 may be constructed from stainless steel, ultra high molecular weight (UHMW) or delrin plastic, tungsten carbide, or any combination thereof. The particular material or materials utilized for its construction may depend at least partially upon the particular coating application. For example, certain materials may be utilized for epoxies while others are used for paints or stains, and so on. The insert 226 includes a forward surface 248, which is a curved surface in the illustrated embodiment. The forward surface 248 extends from a first annular portion 250 of the insert 226, and has the liquid outlet 222 as a central opening. As noted above, the liquid outlet 222 may be varied by interchanging the insert 226 with another insert having a central opening of a different diameter. The forward surface 248 and the first annular portion 250 have a diameter 252 that allows the insert 226 to extend through the central opening 236 of the tip housing 224. When the insert 226 is placed into the tip housing 224, an abutment surface 254 of a second annular portion 256 of the insert 226 is placed against an inner surface 258 of the tip housing 224, while the first annular portion 250 of the insert 226 extends through the central opening 236 of the tip housing 224. As noted above, the insert 226 and the tip housing 224, in some embodiments, may be a single piece.

The annular member 230, as illustrated, includes a first abutment surface 260 that abuts a rear surface 262 of the second annular portion 256 of the insert 226. A central orifice 264 of the annular member 230 allows a liquid needle valve, such as the needle valve 74 described above with respect to FIG. 9, to extend from an interior of the spray device 10 and through the fluid tip and seat assembly 220. The annular member 230 also has a rear abutment surface 266 that abuts against a nozzle portion, such as the nozzle portion 156 described above with respect to FIG. 9. In an embodiment, the annular member 230 acts to seal the nozzle portion 156 against the fluid tip and seat assembly 220 to prevent fluid leakage. In this regard, the annular member 230 may be constructed from any material that is able to seal the nozzle portion 156 against the fluid tip and seat assembly 220, for example synthetic and/or natural rubbers, plastics, ceramics, sintered materials, porous materials, malleable or soft metals, and so on.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray coating device, comprising:

a removable liquid nozzle having a liquid passage extending to a liquid outlet configured to output a liquid flow; and a removable air cap separate from the removable liquid nozzle, wherein the removable air cap comprises an air passage extending to a plurality of air outlets configured to output an air flow, the plurality of air outlets are disposed in a curved arrangement at least partially around a liquid flow axis of the liquid outlet, the plurality of air outlets is angled inwardly toward the liquid flow axis without intersecting the liquid flow axis, the plurality of air outlets is angled to swirl the air flow, the plurality of air outlets comprises a first plurality of air outlets configured to swirl the air flow in a first rotational direction about the liquid flow axis, the plurality of air outlets comprises a second plurality of air outlets configured to swirl the air flow in a second rotational direction about the liquid flow axis opposite from the first rotational direction, and at least some of the plurality of air outlets are configured to output the airflow to facilitate atomization of the liquid flow output from the liquid outlet.

2. The system of claim 1, comprising a spray head component having the removable liquid nozzle and the removable air cap.

3. The system of claim 1, wherein at least some of the first plurality of air outlets in a first region are sized larger than at least some of the second plurality of air outlets in a second region, wherein the second region is downstream from the first region.

4. The system of claim 1, wherein the removable air cap comprises a central opening, and the removable liquid nozzle has the liquid outlet oriented coaxial with the central opening.

5. The system of claim 4, wherein the removable liquid outlet comprises a circular liquid outlet.

6. The system of claim 4, comprising a liquid valve extending into the removable liquid nozzle, wherein the liquid valve is configured to open and close against an inner nozzle surface of the removable liquid nozzle.

7. The system of claim 1, wherein the first plurality of air outlets is disposed on a central surface of the removable air cap, and the second plurality of air outlets is disposed on a plurality of outer protrusions of the removable air cap.

8. The system of claim 7, wherein the plurality of outer protrusions comprises first and second air horns spaced apart from one another, the first air horn comprises a first inner surface that curves circumferentially about the liquid flow axis of the liquid outlet, the second air horn comprises a second inner surface that curves circumferentially about the liquid flow axis of the liquid outlet, and the second plurality of air outlets is disposed on the first and second inner surfaces.

9. The system of claim 8, wherein the first inner surface comprises a first concave surface, the second inner surface comprises a second concave surface, and the first and second concave surfaces face one another about the liquid flow axis.

10. The system of claim 1, wherein the spray coating device comprises a handle, a body coupled to the handle, and a spray head coupled to the body, wherein the spray head comprises the removable liquid nozzle and the removable air cap.

11. The system of claim 10, wherein the spray coating device comprises a trigger coupled to a liquid valve and an air valve, the liquid valve is disposed in the liquid passage, and the air valve is disposed in the air passage.

12. The system of claim 1, wherein the removable air cap comprises one or more protrusions extending downstream from the liquid outlet, and each of the one or more protrusions comprises one or more of the plurality of air outlets configured to swirl the liquid flow.

13. The system of claim 1, wherein the removable air cap comprises first and second air horns extending downstream from the liquid outlet, wherein the second plurality of air outlets comprises a plurality of first air shaping outlets spaced circumferentially about the liquid flow axis along a first inner surface of the first air horn and a plurality of second air shaping outlets spaced circumferentially about the liquid flow axis along a second inner surface of the second air horn, wherein the plurality of first and second air shaping outlets are angled to swirl the air flow downstream from the liquid outlet.

14. The system of claim 1, wherein the removable liquid nozzle excludes any air passages extending therethrough.

15. The system of claim 7, wherein at least some of the first plurality of air outlets on the central surface are sized larger than at least some of the second plurality of air outlets on the plurality of outer protrusions.

16. A system, comprising:

a spray head air cap, comprising:

a central opening configured to receive a removable liquid nozzle having a liquid outlet; and a plurality of air outlets comprising a plurality of air flow axes, wherein the plurality of air outlets is configured to output an air flow along the plurality of air flow axes, the plurality of air outlets are disposed in a curved arrangement at least partially around a liquid flow axis, the plurality of air outlets is angled inwardly toward the liquid flow axis without intersecting the liquid flow axis, the plurality of air outlets comprises a first plurality of air outlets configured to swirl the air flow in a first rotational direction about the liquid flow axis, the plurality of air outlets comprises a second plurality of air outlets configured to swirl the air flow in a second rotational direction about the liquid flow axis opposite from the first rotational direction, and at least some of the plurality of air outlets are configured to output the airflow to facilitate atomization of a liquid flow output from the liquid outlet.

17. The system of claim 16, wherein the first plurality of air outlets is configured atomize a liquid flow into a spray at a first region, and the second plurality of air outlets is configured to shape the spray at a second region downstream from the first region.

18. The system of claim 16, wherein at least some of the first plurality of air outlets in a first region are sized larger than at least some of the second plurality of air outlets in a second region, wherein the second region is downstream from the first region.

19. The system of claim 16, wherein the spray head air cap is a removable air cap having an air horn protruding from a central surface of the removable air cap, the air horn comprising at least a portion of the second plurality of air outlets and curving circumferentially about the central surface at an arc between about 1 degree and about 180 degrees.

20. The system of claim 19, wherein comprising a fluid tip and seat assembly configured to be removably inserted into the air cap, the fluid tip and seat assembly comprises the removable liquid nozzle disposed on a tip housing, wherein the tip housing is disposed in the air cap, and the removable liquid nozzle comprises a liquid outlet.

21. The system of claim 20, wherein the removable liquid nozzle comprises a tapered inner surface configured to interface with a needle valve of a spray device, and the removable liquid nozzle and the tip housing comprise one piece or separate pieces.

22. The system of claim 16, wherein the spray head air cap comprises one or more protrusion extending downstream from a liquid outlet, and each of the one or more protrusions comprise one or more of the second plurality of air outlets.

23. The system of claim 16, wherein the spray head air cap comprises first and second air horns extending downstream from the central opening, wherein the second plurality of air outlets comprises a plurality of first air shaping outlets spaced circumferentially about the liquid flow axis along a first inner surface of the first air horn and a plurality of second air shaping outlets spaced circumferentially about the liquid flow axis along a second inner surface of the second air horn, wherein the plurality of first and second air shaping outlets are angled to swirl the air flow downstream from the central opening.

24. The system of claim 16, comprising the removable liquid nozzle excluding any air passages extending therethrough.

25. The system of claim 16, comprising the removable liquid nozzle having only one fluid passage extending therethrough.

26. The system of claim 16, comprising the removable liquid nozzle having an annular insert disposed removably in an annular housing separate from a body of a spray coating device, wherein the annular housing is disposed removably in the central opening of the spray head air cap, the annular insert is disposed removably in a bore through the annular housing, the annular insert has the liquid outlet, and the spray head air cap is configured to couple to the body of the spray coating device at a location radially offset from the removable liquid nozzle.

27. The system of claim 16, comprising the removable liquid nozzle having an angled annular end surface extending directly to the liquid outlet.

28. The system of claim 27, wherein the angled annular end surface comprises at least one of a tapered surface or a curved surface extending circumferentially about the liquid flow axis.

29. The system of claim 16, wherein the spray head air cap comprises a central surface extending circumferentially about the central opening, and the first plurality of air outlets comprises at least six or more air outlets circumferentially spaced about the central opening along the central surface.

30. A system, comprising:

a spray head component, comprising:

a central surface having a central opening configured to allow output of a liquid flow along a liquid flow axis;

a plurality of air atomization outlets disposed about the central opening along the central surface, wherein the plurality of air atomization outlets are configured to swirl an air flow on a first rotational direction about the liquid flow axis;

a first air horn protruding from the central surface at a first offset distance from the central opening, wherein the first air horn comprises a first inner surface that curves circumferentially about the liquid flow axis, and the first inner surface comprises at least one first air shaping outlet configured to swirl an air flow in a second rotational direction about the liquid flow axis; and a second air horn protruding from the central surface at a second offset distance from the central opening, wherein the second air horn comprises a second inner surface that curves circumferentially about the liquid flow axis, and the second inner surface comprises at least one second air shaping outlet configured to swirl an air flow in the second rotational direction about the liquid flow axis, wherein the first and second rotational directions are opposite from one another.

31. The system of claim 30, wherein the plurality of air atomization outlets each have a diameter between about 0.005 in and about 0.05 in.

32. The system of claim 30, wherein at least one of the first and second air shaping outlets is at least about 10% larger than each of the plurality of air atomization outlets.

33. The system of claim 30, wherein the plurality of air atomization outlets are disposed in a curved arrangement.

34. The system of claim 30, wherein the at least one first air shaping outlet comprises a plurality of first air shaping outlets spaced circumferentially about the liquid flow axis along the first inner surface of the first air horn, the at least one second air shaping outlet comprises a plurality of second air shaping outlets spaced circumferentially about the liquid flow axis along the second inner surface of the second air horn, and the plurality of first and second air shaping outlets are angled to swirl the air flow downstream from the plurality of air atomization outlets along the central surface.

35. The system of claim 34, wherein the plurality of first air shaping outlets comprises three of the first air shaping outlets, and the plurality of second air shaping outlets comprises three of the second air shaping outlets.

36. A system, comprising:

a spray coating device, comprising:

a removable liquid nozzle having a liquid passage extending to a liquid outlet configured to output a liquid flow; and a removable air cap separate from the removable liquid nozzle, wherein the removable air cap comprises an air passage extending to a plurality of air outlets configured to output an air flow, the plurality of air outlets are disposed in a curved arrangement at least partially around a liquid flow axis of the liquid outlet, the plurality of air outlets is angled inwardly toward the liquid flow axis without intersecting the liquid flow axis, the plurality of air outlets is angled to swirl the air flow, at least some of the plurality of air outlets are configured to output the airflow to facilitate atomization of the liquid flow output from the liquid outlet, the plurality of air outlets comprises a first plurality of air outlets disposed on a central surface of the removable air cap, the plurality of air outlets comprises a second plurality of air outlets disposed on a plurality of outer protrusions of the removable air cap, and at least some of the first plurality of air outlets on the central surface are sized larger than at least some of the second plurality of air outlets on the plurality of outer protrusions.

* * * * *